US005667135A

United States Patent [19]

Schaefer

[11] Patent Number: 5,667,135

[45] Date of Patent: Sep. 16, 1997

[54] THERMAL INSULATING SLEEVE FOR DRINK CUPS

[75] Inventor: Robert J. Schaefer, Baltimore, Md.

[73] Assignee: Sweetheart Cup Company, Inc., Owing Mills, Md.

[21] Appl. No.: 633,946

[22] Filed: Apr. 17, 1996

[51] Int. Cl.[6] ..... B65D 3/22; B65D 5/62

[52] U.S. Cl. ..... 229/403; 220/738; 229/400

[58] Field of Search ..... 383/118; 428/136; 229/400, 403, 906.1; 220/412, 737, 738, 739, 903; 206/217; 493/88, 89, 111–113, 152, 908, 909

[56] References Cited

U.S. PATENT DOCUMENTS

| | | | |
|---|---|---|---|
| 2,035,384 | 3/1936 | Hinchliff | 383/118 |
| 2,194,898 | 3/1940 | Hanford . | |
| 2,261,307 | 11/1941 | Still | 428/136 |
| 2,661,889 | 12/1953 | Phinney | 220/903 |
| 3,051,365 | 8/1962 | Sayford, Jr. . | |
| 3,655,501 | 4/1972 | Tesch | 383/118 |
| 3,781,183 | 12/1973 | Doll | 428/136 |
| 3,843,485 | 10/1974 | Doll et al. | 383/118 |
| 3,908,523 | 9/1975 | Shikaya . | |
| 4,091,925 | 5/1978 | Griffo et al. | 383/118 |
| 5,203,490 | 4/1993 | Roe . | |
| 5,205,473 | 4/1993 | Coffin, Sr. . | |
| 5,222,656 | 6/1993 | Carlson . | |
| 5,226,585 | 7/1993 | Varano . | |
| 5,454,484 | 10/1995 | Chelossi | 220/738 |
| 5,538,778 | 7/1996 | Harwitz et al. | 428/136 |

FOREIGN PATENT DOCUMENTS

| | | | |
|---|---|---|---|
| 1133657 | 11/1968 | United Kingdom | 383/118 |

OTHER PUBLICATIONS

The Wiley Encyclopedia of Packaging Technology, John Wiley & Sons, (1986) pp. 14–16, 497–499.

*Primary Examiner*—Gary E. Elkins

*Attorney, Agent, or Firm*—Nixon & Vanderhye P.C.

[57] ABSTRACT

A "honeycombed" insulative sleeve is positionable around a portion of a beverage cup side wall. The sleeve is made from a preform which includes a plurality of circumferentially spaced-apart rows of generally longitudinally oriented and off-set slits. The slits thereby allow the sleeve to expand circumferentially when portioned on a portion of the beverage cup side wall and, by virtue of such circumferential expansion, thereby form the insulative honeycomb structure therearound.

5 Claims, 4 Drawing Sheets

THERMAL INSULATING SLEEVE FOR DRINK CUPS

CROSS-REFERENCE TO RELATED APPLICATIONS

This application is related to commonly owned Design U.S. patent application Ser. No. 29,053,198 filed concurrently herewith (Atty. Dkt. No. 956-153), the entire content of which is expressly incorporated hereinto by reference.

FIELD OF INVENTION

The present invention relates generally to drink cups, particularly, drink cups for holding relatively hot beverages. More particularly, the present invention relates to thermally insulated hot drink cups.

BACKGROUND OF THE INVENTION

Hot beverages (e.g., coffee, tea, hot chocolate, and the like) can present a handling problem to the consumer when dispensed into paperboard drink cups. That is, paperboard drink cups typically do not inherently provide sufficient thermal insulation properties when filled with hot beverages. As a result, an uncomfortable amount of the heat is transferred from the beverage contained in the drink cup to the consumer's hand resulting in some handling difficulty during beverage consumption.

In order to minimize such discomfort for customers, many retailers of hot beverages have resorted to using at least a pair of nested drink cups (so-called "double-cupping") so that the outer drink cup provides some degree of thermal insulation for the hot beverage contained by the inner drink cup. Such a precautionary technique, however, results in increased cup costs for the beverage retailer.

Other alternatives have also been proposed, such as cup sleeves disclosed in U.S. Pat. Nos. 3,908,523 to Shikaya, 5,205,473 to Coffin, Sr. and 5,222,656 to Carlson. The Shikaya '523 and Coffin, Sr. '473 patents each suggest providing thermal insulating sleeves for beverage cups having generally longitudinally oriented corrugations. The Carlson '656 patent suggests forming a tubular insulating sleeve from a felt-like material.

Recently, a paperboard sleeve has been offered for sale by Java Jacket of Portland, Oreg. The Java Jacket paperboard sleeve is an arcuate section of relatively heavy weight paperboard whose surfaces have been impressioned with rows of off-set dimples between which is formed a series of raised reliefs. Opposed slits at each end of the arcuate section allow the ends to be interlocked so that the sleeve may be held in position around the exterior of a paperboard container.

SUMMARY OF THE INVENTION

Broadly, the present invention is embodied in a "honeycombed" insulative sleeve for a beverage cup side wall. More specifically, the sleeve according to this invention includes a plurality of circumferentially spaced-apart rows of generally longitudinally oriented and off-set slits. The slits thereby allow the sleeve to expand circumferentially when portioned on a portion of the beverage cup side wall and, by virtue of such circumferential expansion, to thereby form an insulative honeycomb structure therearound.

Further aspects and advantages of this invention will become more clear from the following detailed description of the preferred exemplary embodiments thereof.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
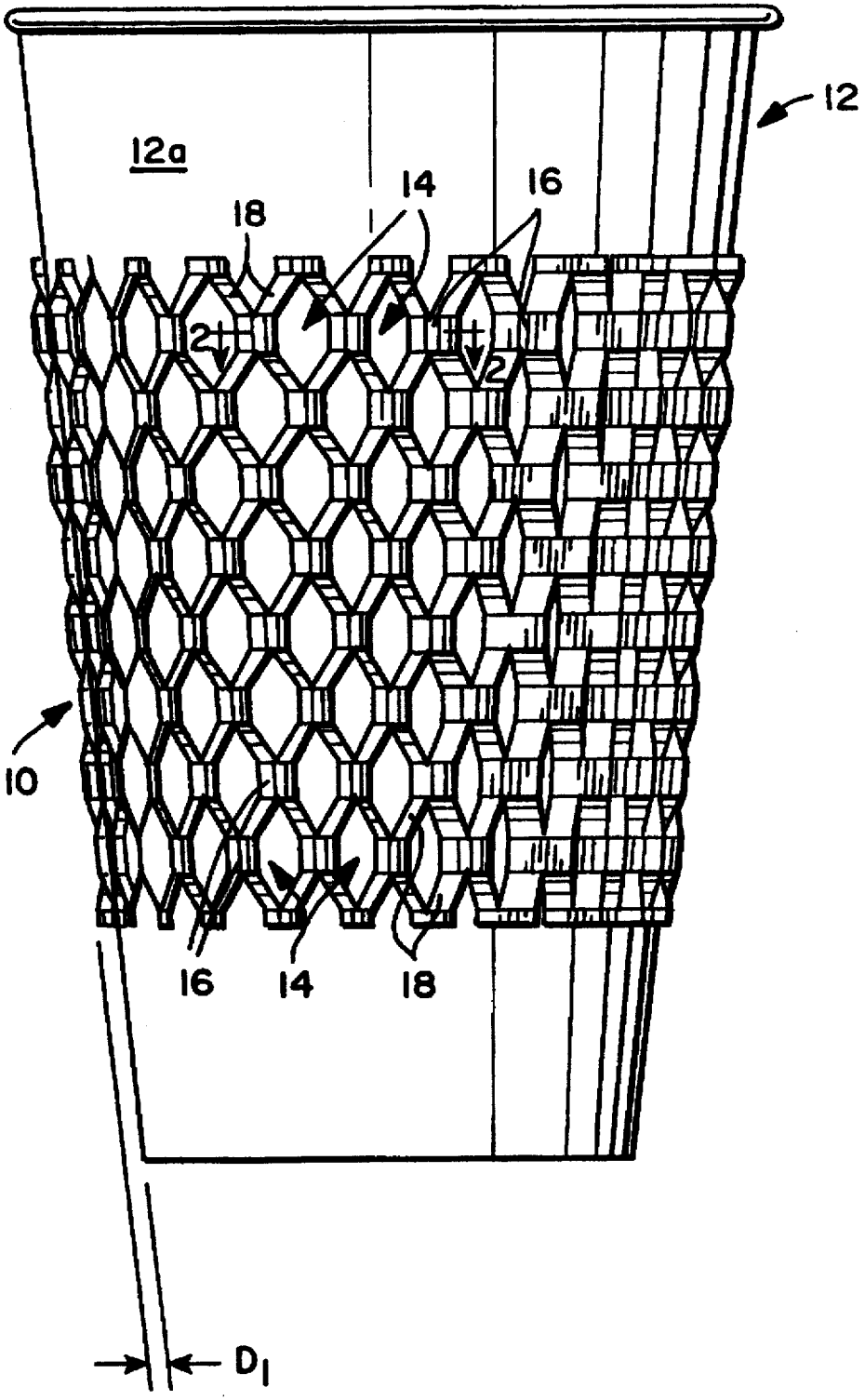
FIG. 1 is an elevational view showing a beverage drink cup with a honeycombed sleeve according to this invention positioned on a portion of the drink cup's generally frustroconically shaped side wall.
Figure 2:
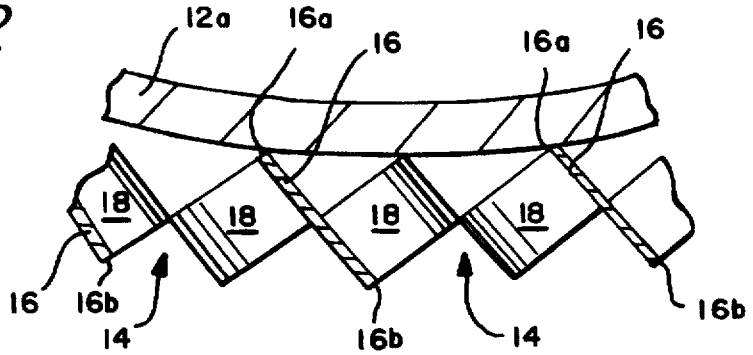
FIG. 2 is a cross-sectional plan view of the sleeve as taken along lines 2—2 in FIG. 1.

An exemplary sleeve 10 according to this invention is shown in accompanying FIG. 1 and 2 as being positioned about a circumferential segment of the generally frustroconically shaped side wall 12*a* of drink cup 12. The sleeve 10 is formed of a plurality of generally hexagonally-shaped openings 14 established by a series of circumferentially adjacent rows of generally longitudinally off-set side sections 16 interconnected to one another by a network of bridge sections 18. In this regard, only a representative few of the openings 14, side sections 16 and bridge sections 18 are identified in the accompanying FIGURES for ease of depiction.

As can be perhaps be seen more clearly in accompanying FIG. 2, the side sections 16 are disposed in a generally vertically oriented plane which angularly intercepts a tangent plane to the side wall 12*a* of the drink cup 12. That is, each of the side sections 16 will have an inner edge 16*a* which bears against the side wall 12*a* of the drink cup 12, and an outer edge 16*b* which is radially spaced from the side wall 12*a* of the drink cup 12 by a distance $D_1$ (see FIG. 1 ). The precise dimension of distance $D_1$ is determined by the amount of angular inclination of the side sections 16 relative to a tangent plane to the side wall 12*a*, which amount of angular inclination, in turn, is determined to a large extent by the amount of circumferential expansion of the sleeve 10.

The bridge sections 18, on the other hand, are likewise disposed in respective planes which angularly intercept the tangent plane to the side wall 12*a*. In addition, the plane of the bridge sections 18 is oriented in a skewed relationship between vertical and horizontal. As will be appreciated, the more that the planes of the bridge sections 18 are oriented toward horizontal, the more the sleeve has been circumferentially expanded. On the other hand, the more the planes of the bridge sections 18 are oriented toward vertical, the less the sleeve has been circumferentially expanded.

Figure 5:
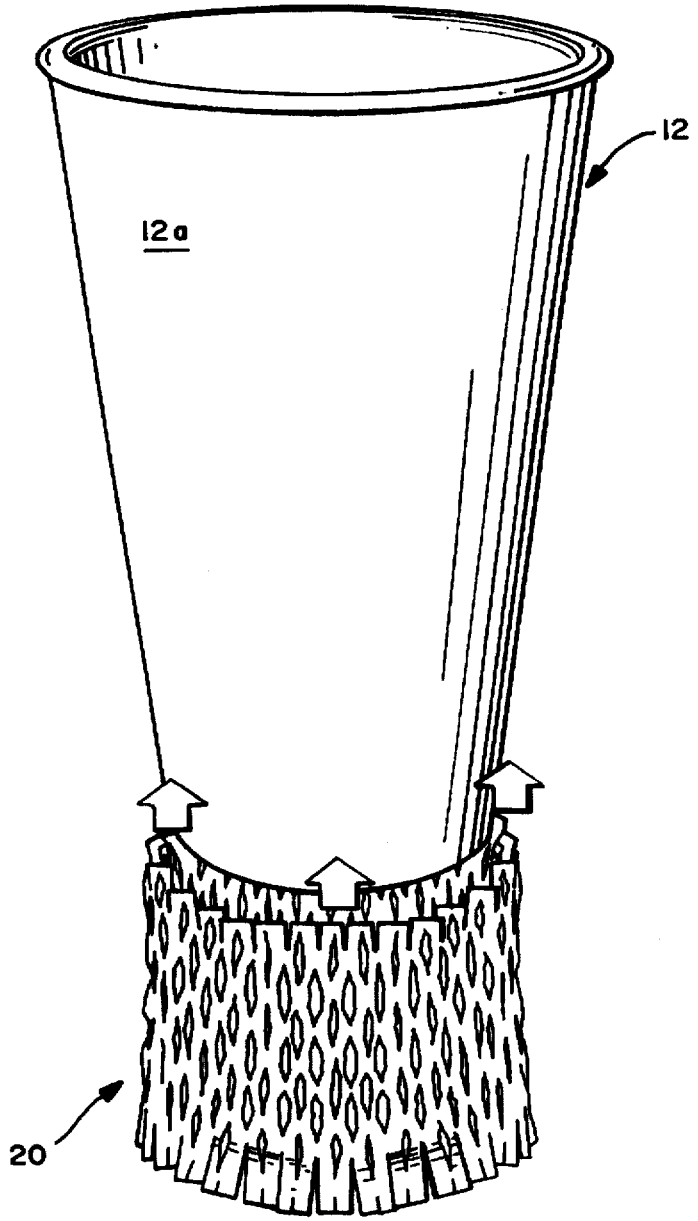
FIG. 5 is an elevational perspective showing the sleeve being inserted over the side wall of the beverage cup.
Figure 3:
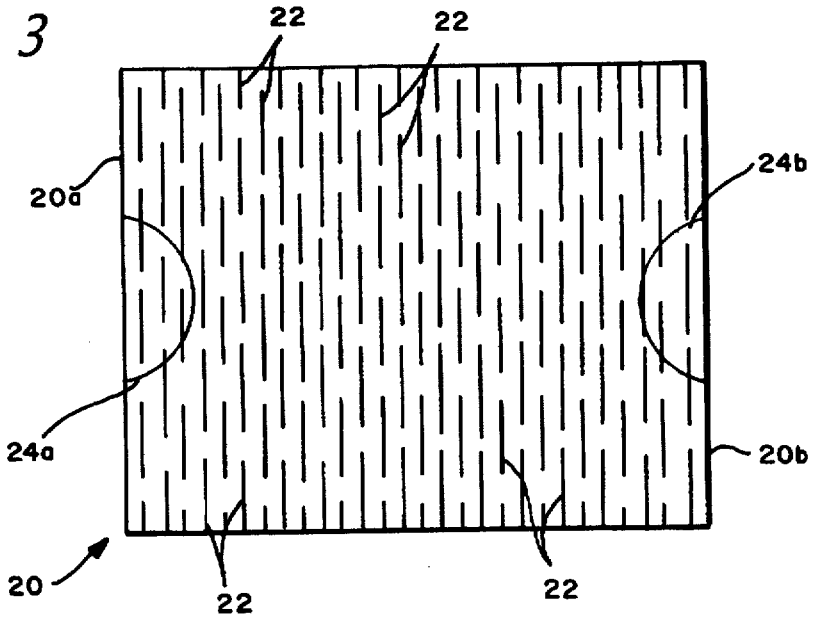
FIG. 3 is an elevational view showing an expandable sleeve preform according to one embodiment of this invention.
Figure 4:
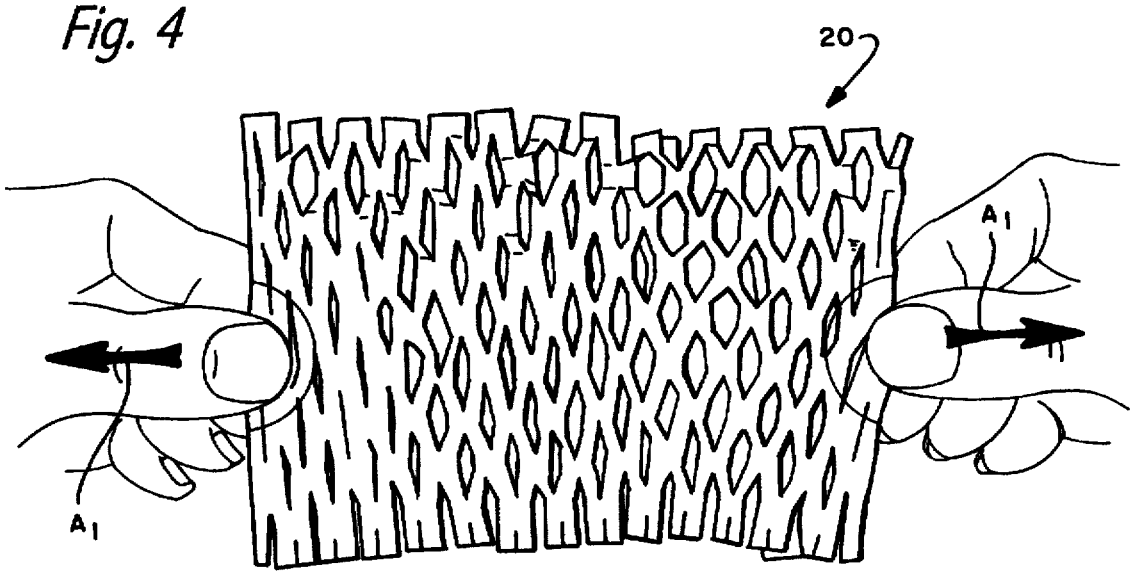
FIG. 4 is an illustration showing the sleeve of FIG. 2 being expanded manually in preparation for insertion over and around the beverage cup's side wall.

One preferred embodiment of a sleeve preform 20 from which the sleeve 10 can be constructed is shown in accompanying FIGS. 3–5. In this regard, the preform 20 is preferably a single sheet of generally cylindrical paper material that has been folded along edges 20*a*, 20*b* so as to form a flat two-ply planar structure. The preform 20 is provided with a series of adjacent parallel rows of slits (a few of which are identified in FIG. 3 by reference numeral 22). In addition, it will be observed that the slits 22 of one row are off-set from (misaligned with) the slits 22 of adjacent rows.

In use, the sleeve preform 20 will be grasped manually generally in the regions 24a, 24b of edges 22a, 22b, respectively, and pulled in opposite directions (arrows $A_1$ in FIG. 4). Such opposite direction forces will thereby cause the slits 22 to expand and thereby increase the effective circumferential dimension of the sleeve preform 20 when opened to its generally cylindrical configuration as shown in FIG. 5. The sleeve preform 20 in such a generally cylindrical configuration, therefore, may be inserted over the side wall 12a of the drink cup 12. It will be understood in this regard that relative advancement of the sleeve preform 20 upwardly onto the generally frustroconically shaped side wall 12a will responsively cause the preform 20 to further circumferentially expand until the state of the expanded sleeve 10 shown in FIG. 1 is attained. Thus, the sleeve 10 according to this invention allows the consumer to handle the drink cup 12 without touching physically the side wall 12a (i.e., since a "stand-off" dimension $D_1$ is provided when the sleeve is positioned around a portion of the side wall 12a). As such, a significant barrier to the heat transferred through the side wall 12a is provided by the sleeve 10 according to this invention.

Figure 6:
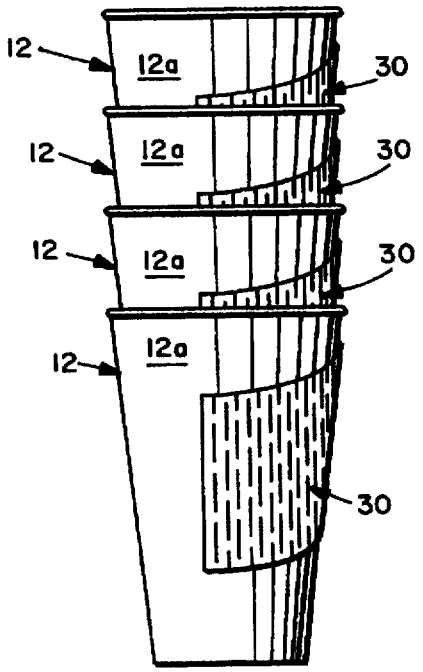
FIG. 6 is an elevational view of a nested stack of drink cups each provided with another embodiment of the thermal insulative sleeve according to the present invention.
Figure 7A:
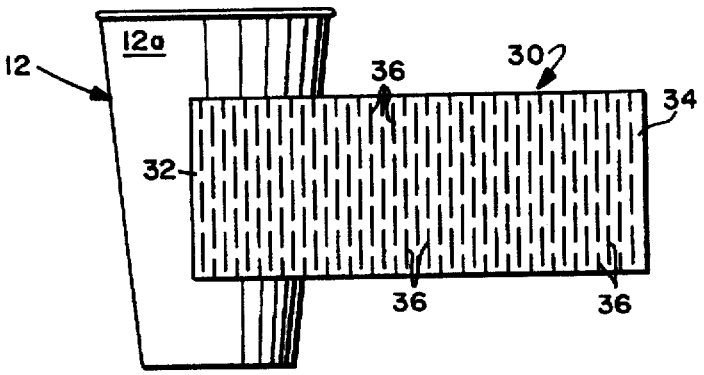
FIGS. 7A and 7B depict in sequence the manner in which the sleeve embodiment depicted in FIG. 6 may be formed positioned around an exterior side wall portion of the drink cup.
Figure 7B:
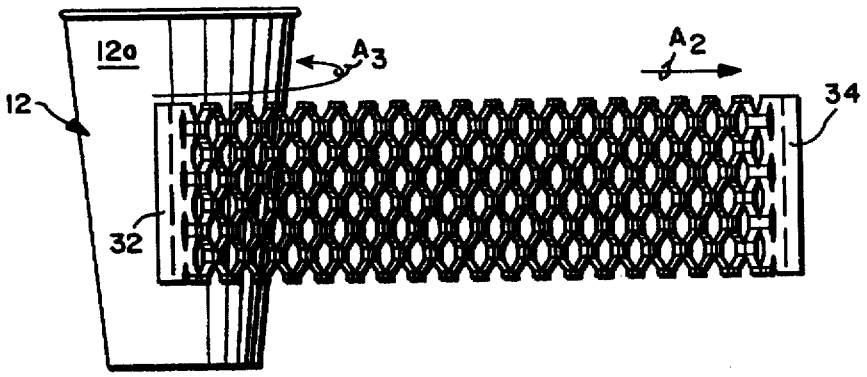

Accompanying FIGS. 6 and 7A–7B depict another preferred embodiment of this invention. As shown therein, the sleeve preform 30 is in the form of a single sheet having adhesive tabs 32, 34 at each lateral end thereof (see FIGS. 7A–7B). Although FIGS. 6 and 7A–7B show the tab 32 as being adhesively affixed to the drink cup 12 so as to allow the drink cups 12 to be nested (e.g., as shown specifically in FIG. 6), it will be understood that the sleeve preform 30 could be provided separately of the drink cup 12. That is, each of the adhesive tabs 32, 34 could be provided with a removable protective film which, when removed by the user, would allow the tabs 32, 34 to be adhesively affixed to the side wall 12a of the drink cup 12 at the point of use. Alternatively, as shown in FIG. 6, the sleeve preform 30 may be provided with one of the tabs 32 pre-affixed to the side wall 12a of the drink cup 12, while the other tab 34 is provided with a removable protective film to allow it to be affixed to the side wall 12a at the point of use.

Preferably, as shown in FIG. 7B, the sleeve preform 30 is stretched widthwise (arrow $A_2$) which opens the individual slits (a few of which are identified in FIG. 7A by reference numeral 36) arranged in vertically oriented and off-set rows similar to the embodiment of the sleeve preform 20 discussed above. Thereafter, the sleeve preform may be wrapped around the side wall 12a of the drink cup 12 (arrow $A_3$) to allow the tab 34 to be adhesively affixed over the tab 32. In such a manner, therefore, the sleeve 10 shown in FIG. 1 will result.

Although the slits 22, 36 are depicted in the accompanying drawings as being generally vertically oriented, it will be understood that orientations other than vertical may be employed. Thus, the slits may be skewed relative to vertical by up to about 70°, and more preferably by up to about 45°, without departing from the present invention. Thus, as used herein and in the accompanying claims, the term "generally vertical" means oriented between about 0° to about 70°, and more preferably between about 0° to about 45°, relative to a truly vertical plane.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A beverage cup comprising:

a generally frustro-conically shaped side wall, and a paper sleeve in surrounding contact with a circumferential portion of said side wall, said sleeve being a honeycomb structure which includes a plurality of openings established by respective substantially planar side sections and interconnecting planar bridge sections, wherein said side sections are oriented in generally vertical planes which angularly intercept a tangent plane to the beverage cup side wall and define an inner edge which bears against the beverage cup side wall, and an outer edge which is radially spaced from the beverage cup side wall, and wherein said bridge sections respectively connect said side sections to one another and are oriented in a skewed relationship between vertical and horizontal.

2. A beverage cup as in claim 1, wherein said sleeve is formed of a single sheet of paper material.

3. A beverage cup as in claim 2, wherein said single sheet of paper material includes adhesive tabs at each lateral end thereof which attach said sleeve in said surrounding contact with said circumferential portion of said side wall.

4. A beverage cup as in claim 2, wherein said single sheet of paper material is generally conically shaped.

5. A beverage cup as in claim 1, wherein said side sections are oriented between about 0° to about 70° relative to a vertical plane.

* * * * *